US008474522B2

(12) United States Patent
Lynde et al.

(10) Patent No.: US 8,474,522 B2
(45) Date of Patent: Jul. 2, 2013

(54) DOWNHOLE MATERIAL RETENTION APPARATUS

(75) Inventors: Gerald D. Lynde, Houston, TX (US); John P. Davis, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 921 days.

(21) Appl. No.: 12/120,764

(22) Filed: May 15, 2008

(65) Prior Publication Data

US 2009/0283330 A1 Nov. 19, 2009

(51) Int. Cl.
*E21B 31/08* (2006.01)

(52) U.S. Cl.
USPC ..... 166/99

(58) Field of Classification Search
USPC ..... 166/99, 227, 301, 311, 229, 205; 175/308
See application file for complete search history.

(56) References Cited

U.S. PATENT DOCUMENTS

| | | | | |
|---|---|---|---|---|
| 1,741,497 | A * | 12/1929 | Boltz | 175/203 |
| 2,675,879 | A * | 4/1954 | Middleton et al. | 166/99 |
| 3,198,256 | A * | 8/1965 | Kirby, II | 166/99 |
| 5,176,208 | A * | 1/1993 | Lalande et al. | 166/99 |
| 6,176,311 | B1 * | 1/2001 | Ryan | 166/99 |
| 6,250,387 | B1 | 6/2001 | Carmichael et al. | |
| 6,607,031 | B2 | 8/2003 | Lynde et al. | |
| 6,776,231 | B2 | 8/2004 | Allen | |
| 6,951,251 | B2 * | 10/2005 | Penisson | 166/312 |
| 7,188,675 | B2 | 3/2007 | Reynolds | |
| 7,322,408 | B2 | 1/2008 | Howlett | |
| 7,562,703 | B2 * | 7/2009 | Palmer et al. | 166/99 |
| 2008/0029263 | A1 | 2/2008 | Palmer et al. | |
| 2009/0126933 | A1 * | 5/2009 | Telfer | 166/301 |

OTHER PUBLICATIONS

P. Connell, et al., Removal of Debris From Deepwater Wellbores Using Vectored Annulus Cleaning System Reduces Problems and Saves Rig Time; SPE 96440; Oct. 2005; 1-6.
S.H. Fowler; A Reeled-Tubing Dowhnole Jet Cleaning System; SPE 21676; Apr. 1991; 411-416.
Lance Portman, et al.; Bit and Mill Selection and Design for Coiled Tubing Applications; SPE 60754; Apr. 2000; 1-8.
D.B. Haughton, et al.; Reliable and Effective Downhole Cleaning System for Debris and Junk Removal; SPE 101727; Sep. 2006; 1-9.
D.B. Haughton, et al.; Method to Reduce Milling and Trip Times During the Recovery Operations of Permanent Production Packers; IADC/SPE 99138; Feb. 2006; 1-4.

* cited by examiner

*Primary Examiner* — Giovanna Wright
*Assistant Examiner* — Kipp Wallace
(74) *Attorney, Agent, or Firm* — Steve Rosenblatt

(57) ABSTRACT

A debris removal device features structural support from an exterior housing that allows more space for debris collection. The debris enters the collection volume from the top to eliminate debris from having to go through a valve. The screen in the device is disposed internally to protect it during handling and running. A variety of external flow diverters are used to direct debris laden fluid into the tool and to keep debris out of an annular space around the tool that could interfere with its removal. The diverters can be actuated by relative movement in the tool or applied pressure to a piston which can inflate a sleeve or orient or misalign paths through brushes for selective bypassing of fluid exterior to the tool.

17 Claims, 5 Drawing Sheets

DOWNHOLE MATERIAL RETENTION APPARATUS

FIELD OF THE INVENTION

The field of the invention is downhole devices that separate cuttings from fluid that was previously pumped through the device to a mill or tool below and return the cuttings-laden fluid up an annular space to pass through the tool again for debris removal.

BACKGROUND OF THE INVENTION

Milling downhole components generates debris that needs to be removed from circulating fluid. Fluid circulation systems featuring flow in different directions have been tried. One design involves reverse circulation where the clean fluid comes down a surrounding annulus to a mill and goes through rather large ports in the mill to take the developed cuttings into the mill to a cuttings separator such as the VACS tool sold by Baker Oil Tools. Tools like the VACS cannot be used above a mud motor that drives the mill and can only be used below a mud motor when using a rotary shoe. Apart from these limitations the mill design that requires large debris return passages that are centrally located forces the cutting structure to be mainly at the outer periphery and limits the application of such a system to specific applications.

The more common system involves pumping fluid through a mandrel in the cuttings catcher so that it can go down to the mill and return up the surrounding annular space to a discrete passage in the debris catcher. Usually there is an exterior diverter that directs the debris laden flow into the removal tool. These designs typically had valves of various types to keep the debris in the tool if circulation were stopped. These valves were problem areas because captured debris passing through would at times cling to the valve member either holding it open or closed. The designs incorporated a screen to remove fine cuttings but the screen was placed on the exterior of the tool putting it in harms way during handling at the surface or while running it into position downhole. These designs focused on making the mandrel the main structural member in the device which resulted in limiting the cross-sectional area and the volume available to catch and store debris. This feature made these devices more prone to fill before the milling was finished. In the prior designs, despite the existence of a screen in the flow stream through the tool, some fines would get through and collect in the surrounding annulus. The fixed debris barriers could get stuck when the tool was being removed. In some designs the solution was to removably mount the debris barrier to the tool housing or to let the debris barrier shift to open a bypass. In the prior designs that used cup seals looking uphole for example, if the screen in the tool plugged as the tool was removed the well could experience a vacuum or swabbing if a bypass around the cup seal were not to open.

Typical of the latter type of designs is U.S. Pat. No. 6,250,387. It accepts debris in FIG. 3 at 11 and all the debris has to clear the ball 12 that acts as a one way valve to retain debris if the circulation is stopped. Debris plugs this valve. The screen 6 is on the tool exterior and is subject to damage in handling at the surface or running it into the well. That screen filters fluid entering at 7 as the tool is removed. It has an emergency bypass 20 if the screen 6 clogs during removal operations. It relies on a large mandrel having a passage 3 which limits the volume available for capturing debris. By design, the cup 5 is always extended.

U.S. Pat. No. 7,188,675 again has a large mandrel passage 305 and takes debris laden fluid in at 301 at the bottom of FIG. 4. It uses internal pivoting valve members 203 shown closed in FIG. 5a and open in FIG. 5b. These valves can foul with debris. It has an exterior screen 303 than can be damaged during handling or running in. Its diverter 330 is fixed.

Finally U.S. Pat. No. 6,776,231 has externally exposed screen material 4 and a debris valve 20 shown in FIG. 3 that can clog with debris. It does show a retractable barrier 9 that requires a support for a part of the tool 7 in the wellbore and setting down weight. However, this barrier when in contact with casing has passages to try to pass debris laden flow and these passages can clog.

Well cleanup tools with barriers that function when movement is in one direction and separate when the tool is moved in the opposite direction are shown in Palmer US Application 2008/0029263. Other articulated barriers are illustrated in U.S. Pat. No. 6,607,031 using set down weight and U.S. Pat. No. 7,322,408 using an inflatable and a pressure actuated shifting sleeve that uncovers a compressed ring to let it expand and become a diverter.

The present invention features one or more of an internal screen, an outer housing for structural support to allow a smaller mandrel and more volume for debris collection, top entry of the debris into the collection volume to eliminate valves that can clog with debris and articulated diverters or diverter to direct debris laden fluid into the tool at the bottom and/or at the top to keep debris from falling into an annular space around the exterior of the tool that may have gotten through the screen or was for some other reason in the wellbore. These and other features of the present invention will be more apparent to those skilled in the art from a review of the description of the various embodiments and the associated drawings with the understanding that the full scope of the invention is given by the claims.

SUMMARY OF THE INVENTION

A debris removal device features structural support from an exterior housing that allows more space for debris collection. The debris enters the collection volume from the top to eliminate debris from having to go through a valve. The screen in the device is disposed internally to protect it during handling and running. A variety of external flow diverters are used to direct debris laden fluid into the tool and to keep debris out of an annular space around the tool that could interfere with its removal. The diverters can be actuated by relative movement in the tool or applied pressure to a piston which can inflate a sleeve or orient or misalign paths through brushes for selective bypassing of fluid exterior to the tool.

BRIEF DESCRIPTION OF THE DRAWINGS

FIG. 1 is a section view of an embodiment of the present invention during run in;

FIG. 3 is an alternative embodiment with an articulated diverter in the retracted position during run in;

FIG. 5 shows a detail of an articulated diverter that operates on set down weight in the retracted position for run in;

DETAILED DESCRIPTION OF THE PREFERRED EMBODIMENT

Figure 1:
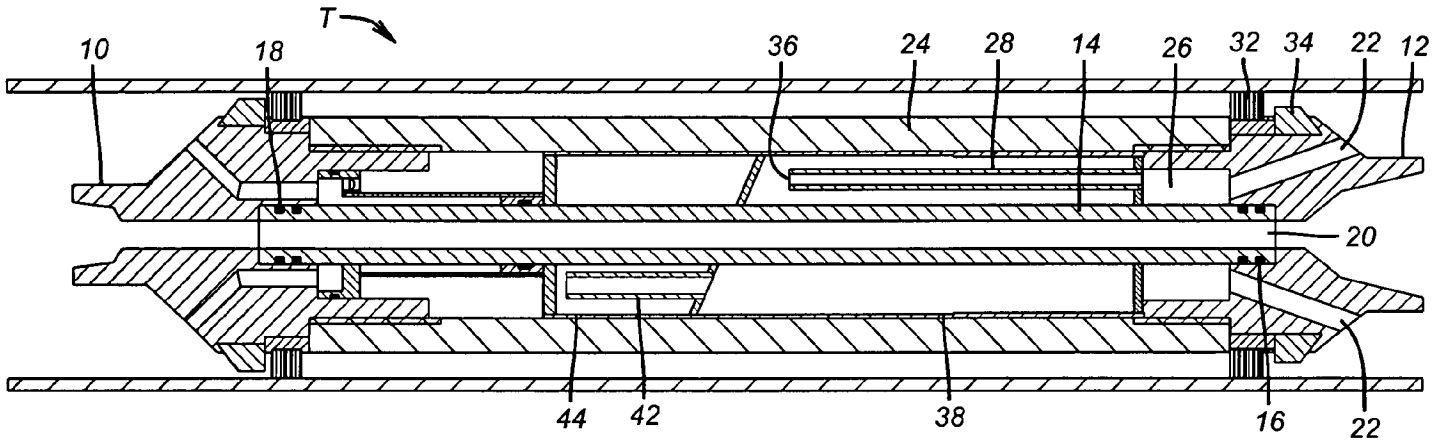

A top sub 10 is connected to a string (not shown) that extends from the surface. A bottom sub 12 is connected to more string and perhaps a downhole motor to a mill at the bottom (all not shown) as the focus of the present invention is the debris removal tool T that is connected to the string and subs 10 and 12. A flow tube 14 is sealed at seal 16 to bottom sub 12 and is sealed at seals 18 to top sub 10. Passage 20 that extends through the flow tube 14 allows fluid from the surface to go through the tool T and down to the mill at the bottom to cool the mill and to remove cuttings and bring them back uphole to inlets 22.

Housing 24 is secured at opposed ends to top sub 10 and bottom sub 12. The hanging weight of the string (not shown) that is attached to bottom sub 12 is transferred through the housing 24 to top sub 10 and the balance of the string (not shown) that is located above top sub 10. Notice that there is no tension in the flow tube 14 from string weight by design. Instead, the flow tube 14 is simply a spacer sealed at opposed ends with seals 16 and 18. Since the flow tube 14 is not structural, it can be made fairly small and its size is determined by the surface pumping equipment, the needed circulation rates for the mill and the length of the string. However, using a small diameter flow tube leaves more room around it to use to catch debris without filling the debris retention volume, as will be later explained. This design feature is one of the aspects of the present invention.

Figure 2:
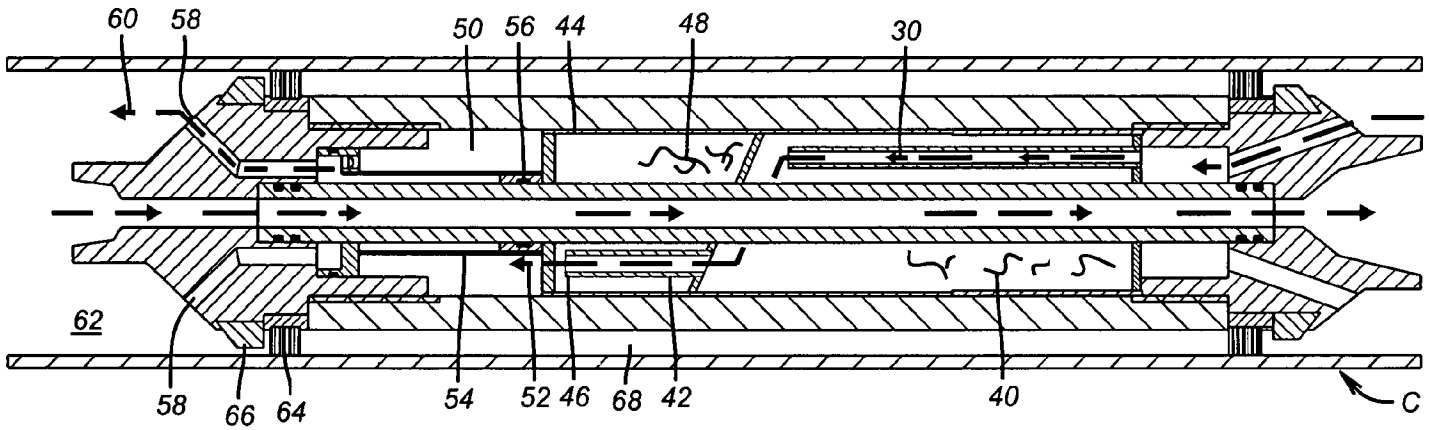
FIG. 2 is the view of FIG. 1 shown during a milling operation with circulation.

The debris laden fluid enters annular passage 26 through inlets 24 and then flows through diverter tube(s) 28 as indicated by arrows 30 in FIG. 2. This happens because there is an external diverter 32 sitting above a stabilizer 34. As will be explained below, the diverter 32 can be mounted on bearings such as shown for example in FIG. 5 so that the external diverter 32 can remain stationary while the tool T is rotated by the string to turn the mill below.

Referring back to FIG. 1, the diverter tube(s) 28 end at 36 above the top of the lower debris retention basket 38. The reduction in fluid velocity allows the heavier debris indicated by arrow 40 to fall into lower basket 38, as shown in FIG. 2. The remaining debris continues and preferably makes a turn to promote additional debris to drop into the basket 38 before the stream continues into an upper diverter tube(s) 42 that run through the bottom of the upper debris retention basket 44 and terminates at end 46. Here again due to the velocity reduction, additional debris indicated by arrow 48 drops into upper basket 44. While two baskets with tubes that come through their sealed bottoms are illustrated with an offset in the flow path between the baskets, those skilled in the art will appreciate that only one basket can be used or more than two baskets with or without offsets in the flow path among them. What should be noted is that the design with a sealed bottom and a diverter tube extending through the closed bottom takes away the need for valves to keep debris in the baskets when circulation is shut off. It is just such valves in the prior art that had to pass debris that gave operational trouble in the past as the debris hung the valves up in the open or the closed positions. The illustrated preferred embodiment eliminates these valves for a system with no moving parts or small passages that can clog with debris.

As seen in FIG. 2 the flow stream represented by arrow 52 now enters an annular passage 50 that is defined on the inside by screen 54 and on the outside by housing 24. The lower end of the inside of screen 54 is sealed to the exterior of the flow tube 14 at seal 56 while the upper end is open inside the screen 54 to outlets 58. From outlets 58 the fluid stream 60 continues in the annulus 62 to the surface. Solids that failed to pass the screen 54 remain in passage 50 on the outer screen face, as long as circulation continues. Once the circulation is cut off those retained cuttings on screen 54 or in space 50 fall down into basket 44. The flow stream 60 heads up the annulus 62 because an upper diverter 64 sitting close to an upper stabilizer 66 prevent flow back down into annular space 68 between the tool T and the surrounding tubular or casing C. Although two diverters 32 and 64 are shown, those skilled in the art will appreciate that only one will also work. The diverters 32 and 64 can be articulated so that they can be selectively retracted or they can be of the type that are always extended such as brushes or brush segments. Even when brushes are used they can selectively have passages through them that can be opened or closed as will be explained below. The diverters are preferably bearing mounted to allow the tool T to turn while the diverters are stationary.

One of the features to be noted at this point is the placement of the screen 54 inside of housing 24 so as to protect the screen 54 from impacts during surface handling or while tripping into and out of the well. The prior designs that used screens located them on the outside of the tool making the screen in those tools more prone to such damage.

In another aspect of the present invention, the external flow diverter or diverters that span the surrounding annulus 68 are articulated as opposed to the fixed deflectors used in the designs of the past. A fixed external flow deflector can cause formation damage either going into the well or coming out of the well. For example, a fixed cup seal looking downhole can build pressure on the formation when running in while if the cup seal is looking uphole it can reduce the formation pressure when the tool is pulled out of the hole to the point where the well actually comes in at the wrong time. While some past designs have incorporated bypasses for such diverters if flow through the tool is blocked when pulling the tool out, for example, there still remains a risk of adversely affecting the formation if such backup features do not fully perform. An articulated diverter as is proposed for the preferred embodiment eliminates this risk when moving in both directions as it can be placed in external bypass mode for running in and for coming out of the well and can also be energized for milling. The various embodiments of the diverter on the outside of the tool will now be described in conjunction with also describing an alternative embodiment for the internals of the tool.

Figure 3:
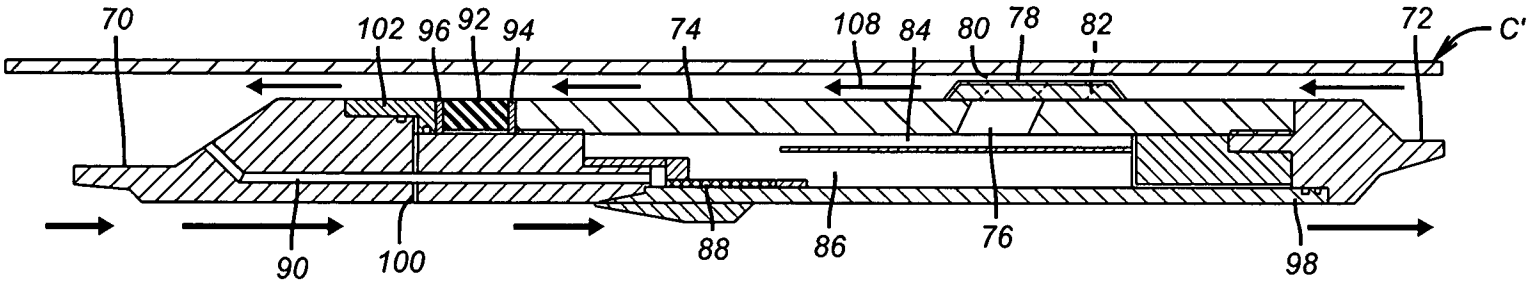
Figure 4:
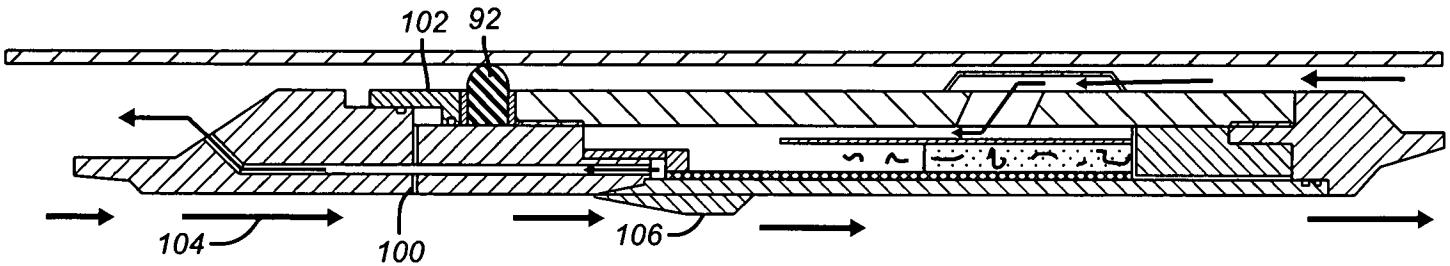
FIG. 4 is the view of FIG. 3 with increased circulation that extends the debris barrier.

FIG. 3 illustrates a tool that has a top sub 70 secured to a bottom sub 72 by a housing 74. Housing 74 has an inlet 76 although the inlet can optionally come through the bottom sub 72. Adjacent the inlet 76 is a projecting diverter 78 that leaves a gap 80 from the surrounding tubular C'. Optionally one or more offset and preferably spiral paths 82 can extend through the diverter 78 with such paths 82 leading into inlet 76. Entering debris goes up passage 84 and due to velocity reduction falls into debris retention volume 86. The remaining debris continues in a flowing stream to screen 88 where additional debris is stopped. After the screen 88 the fluid exits through passages 90 to go uphole in the manner described before. Housing 74 has an inflatable 92 that is mounted on bearings 94 and 96. Flow tube 98 has a lateral passage 100 leading to piston 102 whose movement actuates the inflatable 92 as shown in FIG. 4. Note that flow in the flow tube 98 that is represented by arrow 104 has to go past a restriction 106 so as to build back pressure to passage 100 to set the inflatable 92. The flow 104 continues down to the mill (not shown) and comes back up with cuttings to inlets 76. Note that for run in, there may be flow 104 but at a low enough rate so as not to set the inflatable 92. Even though the diverter 78 presents some restriction to flow around the outside of the tool as it is run into or out of the hole, the gap 80 is designed to be sufficiently large and the rate of going in or coming out of the hole sufficiently controlled so as to avoid adverse impacts on the formation. Indeed, the diverter 78 can be eliminated so that with the inflatable 92 in the retracted position of FIG. 3 there is no added resistance to flow 108 in the surrounding annular space when the tool is run into the whole. The same thing happens when the tool is removed from the hole with the inflatable 92 retracted. Increasing the flow rate when the mill lands on the object to be milled actuates the inflatable 92 so that it can serve as a diverter whether located as shown or anywhere on the housing 74 above the inlets 76.

Those skilled in the art will also appreciate that some of the benefits of the present invention of the FIGS. 1 and 2 embodiment are also in FIGS. 3 and 4. The screen 88 is internally mounted and protected. The outer housing 74 takes the tensile forces of string weight as opposed to the flow tube 98 to allow the flow tube 98 to be made smaller and thus making a greater volume within the housing 74 available for debris retention. There are no valves that debris laden fluid has to go through that can clog and get stuck. The diverter 92 is articulated and in this embodiment automatically extended when flow rates for milling are maintained. Running in or out of the well with the diverter 92 fully retracted removes or at least minimizes the potential for damaging the formation during such operations.

Figure 5:
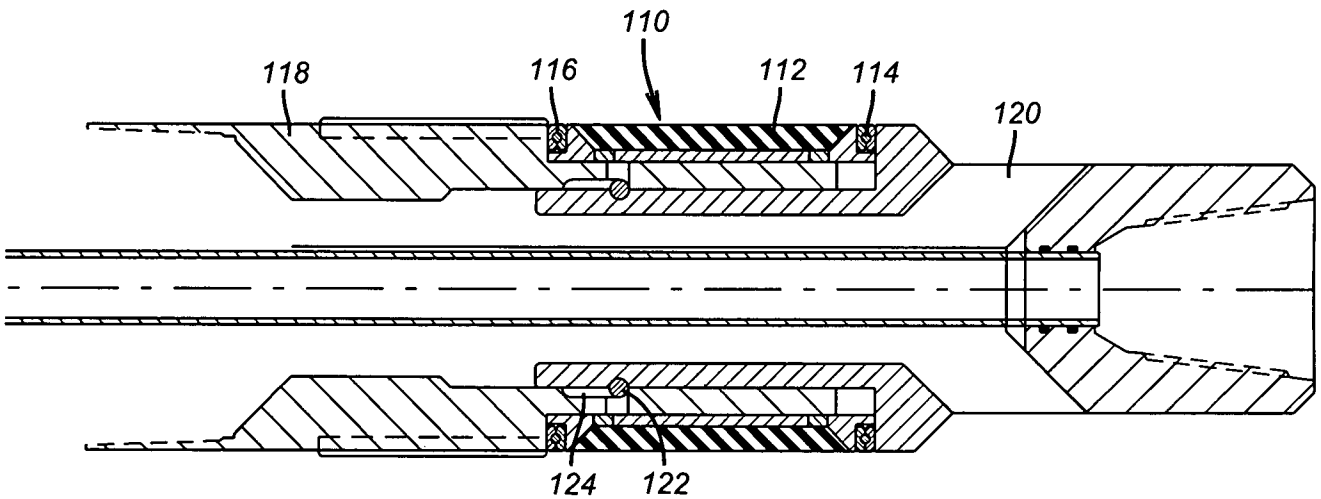

Referring to FIG. 5 an articulated diverter 110 comprises a sleeve 112 that is on bearings 114 and 116. An upper sub 118 is movable with set down weight on mandrel 120 to axially compress the sleeve 112 and urge it out radially to close a surrounding gap and act as an articulated diverter. A ball 122 in a track 124 prevents relative rotation between sub 118 and housing 120. These two components can also be shaped with a hex that interlocks them so that they transmit torque while moving in tandem for rotation. Only the diverter 110 is the focus of FIG. 5 with the other FIGS. previously discussed providing the details of the debris catcher operation. Weight is set down when the mill (not shown) lands on the object to be milled and that in turn articulates the sleeve 112 to move out radially. For running in or out the string weight keeps the sleeve 112 extended.

Figure 6:
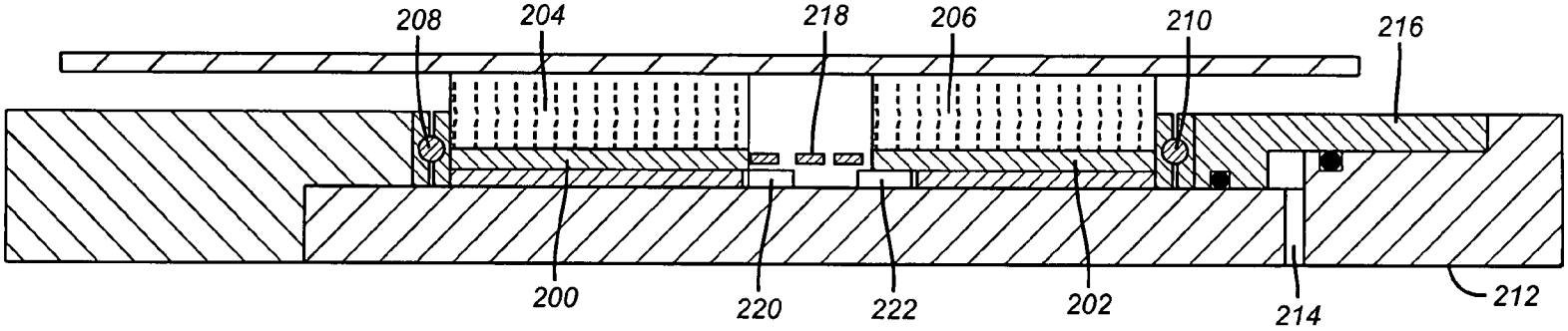
FIG. 6 is another articulated diverter design shown in section and where flow can pass through its brushes.
Figure 7:
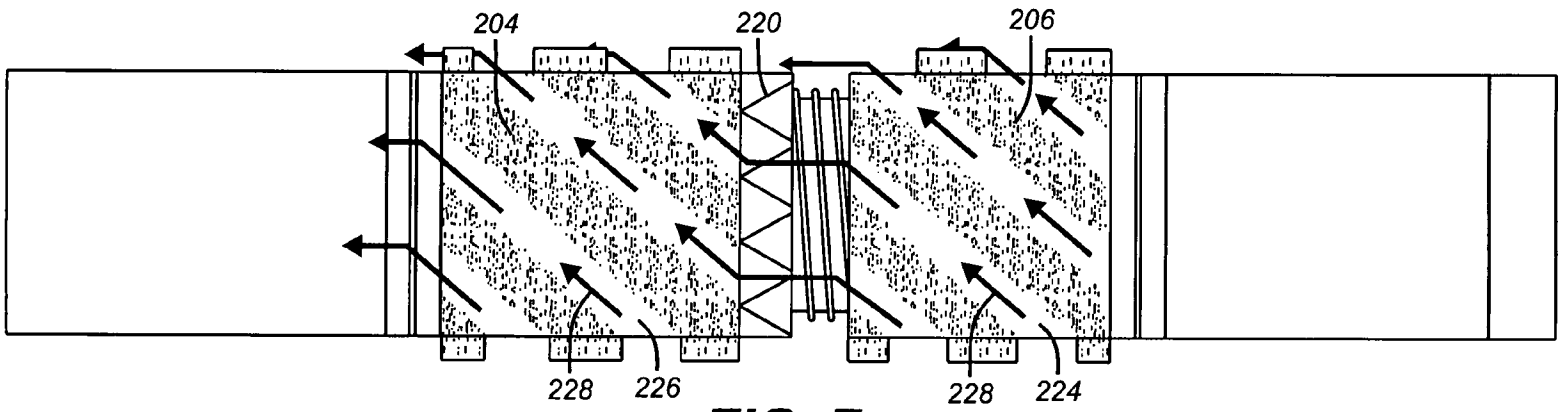
FIG. 7 is the view of FIG. 6 showing in more detail the clutch assembly, which can be used to close the flow paths that are shown in an open position.
Figure 8:
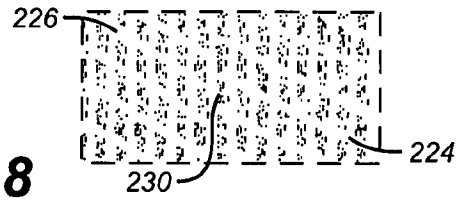
FIG. 8 is an exterior view of the brush sections pushed together so that their flow paths through the brushes are misaligned by the clutch.

FIGS. 6-8 illustrate another embodiment of an articulated diverter. FIG. 6 is a section view and FIG. 7 is an exterior view. FIG. 8 illustrates the flow paths through the brush assemblies in the obstructed position. While brush arrays are preferred, arrays of solid shapes made of a variety of materials such as metal or plastic for example can also be used as long as the shapes define flow paths that can be selectively obstructed to get the diversion of flow effect. Sleeves 200 and 202 have brush arrays 204 and 206 extending radially out. Bearings 208 and 210 support the sleeves 200 and 202 such that the housing or a sub 212 can rotate as the brush arrays 204 and 206 are in contact with a surrounding tubular (not shown). A passage 214 extends to a piston 216 that when actuated pushes the sleeves 200 and 202 together by moving sleeve 202. A spring 218 biases the sleeves 200 and 202 apart until piston 216 overcomes the bias of spring 218. Sleeve 200 has a series of end serrations 220 seen in both FIGS. 6 and 7. Sleeve 202 has serrations 222 seen only in FIG. 7 because they are recessed under sleeve 202. Serrations 220 and 222 are a matched pair and self align when forced together with piston 216. When the sleeves 200 and 202 are apart as shown in FIG. 7 there are spiral flow paths 224 and 226 that allow a continuous flow stream represented by arrows 228 to pass through the brush arrays 204 and 206 with minimal resistance. However, when piston 216 is actuated to bring serrations 220 and 222 together while overpowering spring 218 the flow paths 224 and 226 misalign at the point 230 where they are pushed together. With the flow paths so misaligned the brush arrays 204 and 206 act as a diverter. These FIGS. 6-8 illustrate yet another embodiment of an articulated diverter having the advantages described before. As before it actuates automatically when the flow rate is stepped up to levels needed for mill operation.

Figure 9:
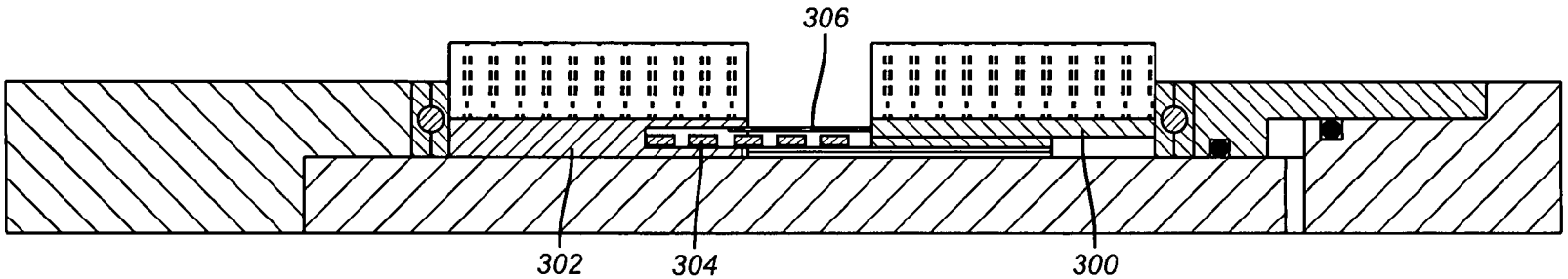
FIG. 9 is an alternative embodiment to FIG. 6 involving translation and putting a cover over the spring to keep dirt out of it.
Figure 10:
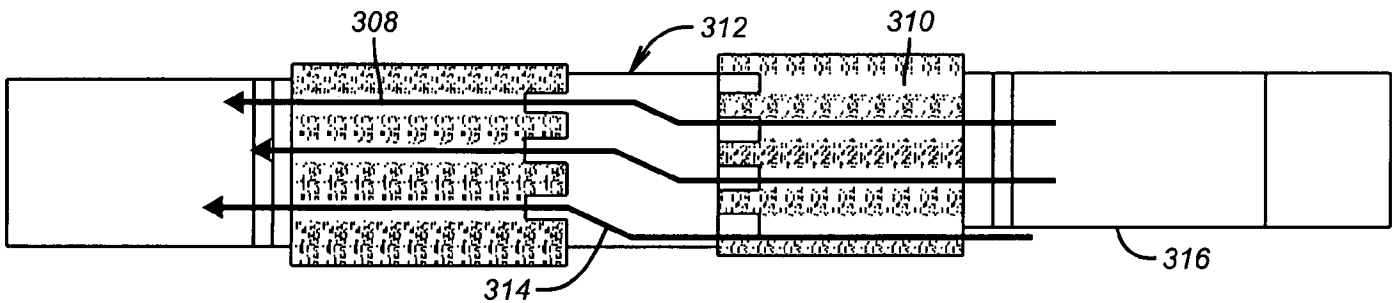
FIG. 10 is an exterior view of the embodiment of FIG. 9 in the open flow position.
Figure 11:
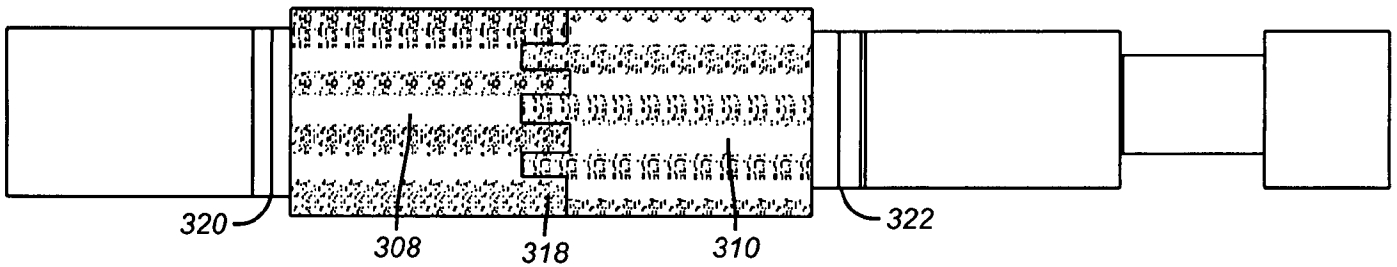
FIG. 11 is the view of FIG. 10 in the blocked flow position.

FIGS. 9-11 are an alternative embodiment again showing sleeves 300 and 302 with sleeve 300 movable biased apart by spring 304 which is covered by sleeve 306 to prevent entry of debris. In the open position of FIG. 10 the paths 308 and 310 are spaced apart forming a gap 312. Flow can go through as represented by arrow 314. Sleeves 300 and 302 can be splined so they can translate axially without relative rotation. Since paths 308 and 310 are misaligned, translation of the sleeves 300 and 302 urged by piston 316 in effect creates dead ends 318 that block flow. This can be done by simply abutting the arrays or nesting them with mating notch patterns as shown in FIGS. 10 and 11. As before bearings 320 and 322 allow relative rotation so that the arrays that define paths 308 and 310 can remain still while other parts of the tool rotate. As before, while brush arrays are preferred arrays made of solid shapes that define paths can also be used in a variety of materials compatible with downhole conditions.

While the present invention can be used in a string for milling it can also be used with other downhole tools that for example jet sand away from the top of a packer and remove it in tool T of the present invention.

The above description is illustrative of the preferred embodiment and many modifications may be made by those skilled in the art without departing from the invention whose scope is to be determined from the literal and equivalent scope of the claims below.

We claim:

1. A debris removal apparatus for mounting in a tubular string downhole that supports a mill that generates the debris or another downhole tool, comprising:

a top and a bottom end for connecting to the string, said ends structurally held together to support string weight from said lower end through an outermost exterior housing;

a flow tube within said outermost exterior housing to conduct flow between said ends to the mill or other downhole tool, said flow tube defining an annular space with said outermost exterior housing;

at least one diverter extending from said outermost exterior housing to divert flow and cuttings returning from the mill or tool from going past said outermost exterior housing on the outside of said outermost exterior housing and to direct flow into said annular space for retention of debris from flow that then exits said annular space;

said diverter is selectively movable between a retracted and an extended position.

2. The apparatus of claim 1, wherein:
said annular space comprises a screen for debris retention.
3. The apparatus of claim 1, wherein:
said annular space comprises at least one debris collection basket having a closed bottom and a tube to carry debris laden fluid extending through said bottom.
4. The apparatus of claim 1, wherein:
said diverter comprises an inflatable member actuated by flow or pressure in said flow tube to be selectively inflated to block the wellbore surrounding said housing.
5. The apparatus of claim 1, wherein:
said diverter comprises a flexible sleeve to selectively block the wellbore around said housing when subjected to set down weight through said housing.
6. The apparatus of claim 1, wherein:
said diverter comprises at least two sleeves each having an array of extending shapes to define at least one passage;
at least one of said arrays is selectively articulated to allow flow or restrict flow between their respective passages.
7. The apparatus of claim 6, wherein:
said sleeves comprise end serrations that when brought together result in blockage of said passages in said arrays.
8. The apparatus of claim 7, wherein:
said sleeves are biased apart and are selectively brought together with flow or pressure in said flow tube.
9. The apparatus of claim 3, wherein:
said at least one debris collection basket comprises a plurality of baskets each with a tube to carry debris laden fluid extending through said bottom and where the tube for one basket is offset circumferentially from another tube in another basket.
10. The apparatus of claim 1, wherein:
said annular space comprises a screen for debris retention.
11. The apparatus of claim 10, wherein:
said annular space comprises at least one debris collection basket having a closed bottom and a tube to carry debris laden fluid extending through said bottom.
12. The apparatus of claim 11, wherein:
said diverter comprises at least two sleeves each having an array of extending shapes to define at least one passage;
at least one of said arrays is selectively articulated to allow flow or restrict flow between their respective passages.
13. The apparatus of claim 12, wherein:
said sleeves comprise end serrations that when brought together result in blockage of said passages in said arrays.
14. The apparatus of claim 13, wherein:
said sleeves are biased apart and are selectively brought together with flow or pressure in said flow tube.
15. The apparatus of claim 1, wherein:
said at least one diverter comprises at least two diverters with at least one being selectively movable between a retracted and an extended position;
at least one diverter comprises a flow path leading into an inlet to said annular space and another diverter mounted to said housing near an opposite end from said inlet.
16. The apparatus of claim 12, wherein:
said extending shapes comprise brushes;
at least one of said sleeves translate or rotates with respect to another said sleeve.
17. The apparatus of claim 1, wherein:
said flow tube does not support any string weight between said ends.

* * * * *